United States Patent [19]

Hatcher

[11] 4,338,983

[45] Jul. 13, 1982

[54] OIL CAP WITH SELF CONTAINED FUNNEL

[76] Inventor: Floyd J. Hatcher, 1017 Harmon, St. Joseph, Mo. 64504

[21] Appl. No.: 166,343

[22] Filed: Jul. 7, 1980

[51] Int. Cl.[3] ..... B65B 39/00

[52] U.S. Cl. ..... 141/331; 141/339

[58] Field of Search ..... 141/331, 339; 210/482; 99/339

[56] References Cited

U.S. PATENT DOCUMENTS

| | | | |
|---|---|---|---|
| 272,415 | 2/1883 | Crapon et al. | 141/339 |
| 1,134,837 | 4/1915 | Fox | 141/331 |
| 3,899,012 | 8/1975 | Sather | 141/331 |
| 4,112,984 | 9/1978 | Gogua et al. | 141/339 |

*Primary Examiner*—James E. Bryant, III

*Attorney, Agent, or Firm*—Kokjer, Kircher, Bradley, Wharton, Bowman & Johnson

[57] ABSTRACT

An oil cap having a self contained funnel is the subject of the present invention. The oil cap is inserted into the engine oil port in place of a conventional cap. An opening in the cap receives a neck portion which extends upwardly and in turn receives a funnel portion. The funnel portion is provided with a cover which may be removed to add engine oil.

2 Claims, 5 Drawing Figures

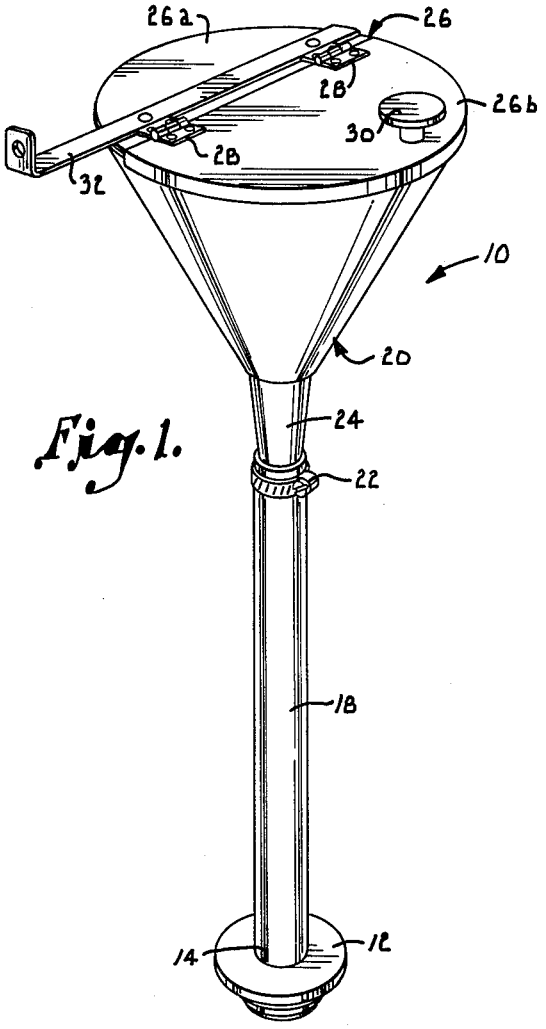
Fig. 1.
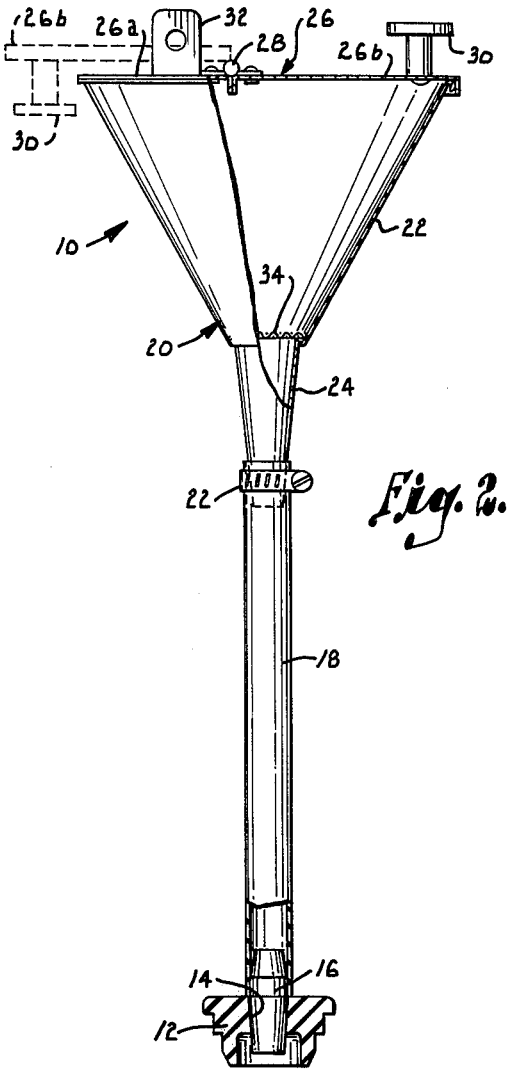
Fig. 2.
Fig. 3.
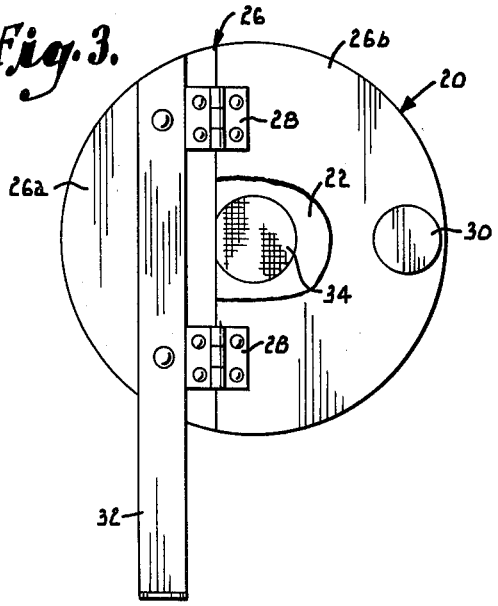
Fig. 4.
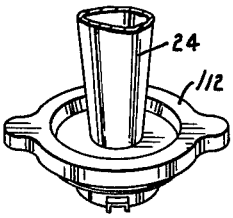
Fig. 5.
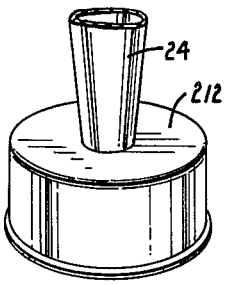

OIL CAP WITH SELF CONTAINED FUNNEL

This invention relates generally to funnel devices and, more particularly, to an engine oil port closure which incorporates a funnel for adding oil.

All internal combustion engines for powering vehicles utilize oil for lubrication. An oil port is provided in the engine block so that the oil may be added. Heretofore, when it has been necessary to add oil to the engine, the cap covering the oil port had to be removed and the oil poured in. If a normal funnel is utilized, it may not be possible to position the funnel all the way into the port, particularly on vehicles where the oil port is well below the access opening to the engine. In some cases, a spout will be inserted into the oil can, but again if the port is relatively low, it is impossible to pour the oil into the engine without spilling some of it.

Another significant problem in adding oil to engines, particularly when the engine is being driven between periodic oil changes, is that the hot engine block poses a danger of serious burns if it is touched. In the case of large truck engines, the oil port is normally located far below the access opening to the engine and if the person reaches into the open area to add oil it is not uncommon to be burned.

It is therefore a primary object of the present invention to provide a cap for the oil port of an engine which incorporates a funnel to allow easier access for adding oil to the engine.

As a corollary to the above object, a principal aim of the invention is to provide a oil port cap incorporating a funnel therein which provides a safer means for adding engine oil by eliminating the need to reach down beside the engine block.

Still another objective of the invention is to provide an oil cap port incorporting a funnel meeting the aims and objects set forth above and which is also easily adapted to different types of engines in both automobiles and trucks.

It is also one of the objectives of this invention to provide for greater oil conservation by substantially eliminating oil spills caused during the addition of oil to an engine by providing an oil port cap which incorporates a funnel as a part of the cap.

Other objects of the invention will be made clear or become apparent from the following description and claims when read in light of the accompanying drawing wherein:

FIG. 1 is a perspective view of the oil cap with self contained funnel according to the present invention;

FIG. 2 is a side elevational view of the device shown in FIG. 1 with portions broken away and shown in cross section for purposes of illustration;

FIG. 3 is a top plan view of the device shown in FIG. 1;

FIG. 4 is a fragmentary perspective view of an alternative form of the invention; and FIG. 5 is a fragmentary perspective view of a second alternative form of the invention.

Referring initially to FIG. 1, the cap and funnel device of the present invention is designated generally by the numeral 10. Device 10 comprises an engine port cap 12 which is configured to be complemental with the port opening (not shown) so as to be received therein. Cap 12 has a central opening 14 (FIG. 2) so that oil may pass through the cap. Opening 14 receives a sleeve coupling 16 which is in tight frictional engagement with the sides of the cap.

Extending upwardly from cap 12 is an elongated straight neck portion 18. Neck portion 18 is coupled with cap 12 by the upper portion of sleeve 16 which is in tight frictional engagement with the walls of the neck portion.

At the top of neck portion 18, a funnel member designated generally by the numeral 20 is received by the neck portion and held in place by a clamp 21. Funnel member 20 includes a frusto conical body 22 which communicates with an integral tapered spicket 24. Funnel member 20 also includes a cover 26 which has a rigid section **26*a* and a movable section 26*b*. The movable section is joined to the rigid section by hinges 28. A knob 30 is provided on movable section 26*b* so as to facilitate opening and closing of it. A bracket 30 is rigidly secured to cover section 26*a* and extends outwardly from one side of funnel member 20** so as to provide means for attaching the device to the engine. In this regard, it is to be understood that in certain instances it may be desirable to attach the device to the fire wall between the engine block and the passenger compartment. Thus, the term "engine" is intended to encompass the fire wall and any other portion of the framework and body which form the engine enclosure.

A screen 34 is located at the juncture between body 22 and spicket 24 so as to serve as a filter for any foreign particles which might be passing through the funnel.

The device 10 of the present invention is intended to be used as a replacement for a conventional engine oil port cap cover. The standard cover is removed and cap 12 is inserted in its place. If required, bracket 22 is secured at a location where it will tightly hold funnel member 20. During normal engine operation, cover 26 remains closed keeping dust and foreign matter out of the engine. In this regard, it is well appreciated that it may be desirable to provide a seal between cover 26 and the top edge of body member 22. If it is necessary to add oil to the engine, all that is needed is to raise section **26*b* and pour the oil into the funnel. Manifestly, the length of neck portion 18 is selected so that the top of funnel 20 will be near the top of the engine opening and yet allow adequate clearance for the hood. In this regard, it is contemplated that neck portion 18** may be constructed of rubber which may be cut by the user to the appropriate length desired.

It is to be understood that the present invention contemplates various types of oil port cap configurations within the scope hereof. Two alternative cap configurations are illustrated in FIGS. 4 and 5 and designated by the numerals 112 and 212. In each of the alternative embodiments, which are intended to be merely illustrative and in no way limiting, spicket portion 24 is coupled directly with the oil port cap thereby eliminating neck portion 18. Particularly in the case of automobile engines where the oil port tends to be located higher on the engine block, it is contemplated that the forms of the invention illustrated in FIGS. 4 and 5 will be employed. The method of utilization of the alternative forms shown in these figures is the same as for the preferred embodiment described above.

From the foregoing description, it will be appreciated that the embodiments herein described accomplish all of the objectives previously set forth and improved means for delivering oil to engines is provided by the present invention.

I claim:

1. A device adapted to be permanently coupled with an engine for closing the oil intake port of the engine, said device comprising:

a cap which is engageable with said port and adapted to be sealingly received by said port, said cap having an opening communicating with said port;

funnel means for directing oil into said port, elongated neck means coupling the end of said funnel means with said cap opening; and cover means coupled with said funnel means for closing said funnel, said cover means presenting a first generally flat section rigid with said funnel means and a second generally flat section hingedly coupled with said first section and movable between open and closed positions; and bracket means rigid with said first flat section for coupling the device with said engine.

2. A device as set forth in claim 1, wherein there is included within said funnel means a filter means for oil passing through the funnel.

* * * * *